US010227109B2

(12) United States Patent
Mullikin

(10) Patent No.: US 10,227,109 B2
(45) Date of Patent: Mar. 12, 2019

(54) WATERCRAFT SECUREMENT DEVICE

(71) Applicant: James Mullikin, Alexandria, KY (US)

(72) Inventor: James Mullikin, Alexandria, KY (US)

( * ) Notice: Subject to any disclaimer, the term of this patent is extended or adjusted under 35 U.S.C. 154(b) by 0 days.

(21) Appl. No.: 15/450,398

(22) Filed: Mar. 6, 2017

(65) Prior Publication Data

US 2017/0297658 A1 Oct. 19, 2017

Related U.S. Application Data

(60) Provisional application No. 62/443,911, filed on Jan. 9, 2017, provisional application No. 62/323,419, filed on Apr. 15, 2016.

(51) Int. Cl.

| | |
|---|---|
| ***B63B 21/00*** | (2006.01) |
| ***B63B 21/20*** | (2006.01) |
| ***B63B 21/08*** | (2006.01) |
| *B63B 21/04* | (2006.01) |

(52) U.S. Cl.

CPC ..... *B63B 21/20* (2013.01); *B63B 21/08* (2013.01); *B63B 21/045* (2013.01); *B63B 2021/203* (2013.01)

(58) Field of Classification Search

CPC ..... B63B 21/00; B63B 21/04; B63B 21/08; B63B 21/10; B63B 21/16; B63B 21/20; B63B 2021/00; B63B 2021/003; B63B 2021/004; B63B 2021/005; B63B 2021/20; B63B 2021/203

USPC ... 114/230.1, 230.2, 230.22, 230.23, 230.24, 114/230.25, 230.26

See application file for complete search history.

(56) References Cited

U.S. PATENT DOCUMENTS

| | | | | |
|---|---|---|---|---|
| 3,094,755 A * | 6/1963 | Casanave | F16G 11/046 | 114/230.2 |
| 4,719,773 A * | 1/1988 | Alberts | E05B 73/0005 | 70/18 |
| 4,842,236 A * | 6/1989 | Yonts | B60P 7/0823 | 248/499 |

(Continued)

OTHER PUBLICATIONS

International Searchiing Authority/USA, International Search Report and Written Opinion of the International Searching Authority, International Application No. PCT/US17/27623, dated Jul. 17, 2017 (12 pages).

(Continued)

*Primary Examiner* — Daniel V Venne

(74) *Attorney, Agent, or Firm* — Wood Herron & Evans LLP

(57) ABSTRACT

A watercraft securement device including a boat attachment line configured for connection to a watercraft and a dock attachment line configured for connection to an anchoring structure. A tensioning apparatus is connected to the boat attachment line and the dock attachment line. The tensioning apparatus is configured to adjust the length of one of the boat attachment line or the dock attachment line. The tensioning apparatus further includes a pulley for engaging the adjustable length and a ratcheting mechanism. The ratcheting mechanism operates to permit rotation of the pulley in only one direction when engaged, and to permit free rotation of the pulley when released. The ratcheting mechanism maintains tension as the adjustable length is pulled through the pulley.

16 Claims, 9 Drawing Sheets

(56) References Cited

U.S. PATENT DOCUMENTS

| | | | | | |
|---|---|---|---|---|---|
| 4,912,816 | A * | 4/1990 | Brandt | B63B 21/00 | 114/230.26 |
| 5,368,281 | A * | 11/1994 | Skyba | B25B 25/00 | 254/217 |
| 5,398,634 | A * | 3/1995 | Eagan | B63B 21/00 | 114/221 R |
| 5,722,640 | A * | 3/1998 | Skyba | B66D 1/7415 | 254/333 |
| 6,149,133 | A | 11/2000 | Skyba | | |
| 6,390,009 | B2 * | 5/2002 | Brown | B63B 21/00 | 114/230.24 |
| 6,637,077 | B2 * | 10/2003 | Doty | B60P 3/079 | 24/298 |
| 6,708,650 | B1 * | 3/2004 | Yates | A01K 27/002 | 119/712 |
| 2005/0061223 | A1 * | 3/2005 | Carr | B63B 21/00 | 114/230.2 |
| 2008/0196650 | A1 * | 8/2008 | Fernung | B63B 21/00 | 114/230.24 |
| 2012/0152161 | A1 * | 6/2012 | Stanley | B63B 21/54 | 114/230.1 |

OTHER PUBLICATIONS

Carolina North Inc. Rope Ratchet Tie-Down, published 1993-2016 (1 page).

Grainger, Rope Ratchet Rope Ratchet, retrieved from https://www.grainger.com/product/ROPE-RATCHET-Rope-Ratchet-Rope-Ratchet-WP5924067, retrieved on Ocober 20, 2016 (1 page).

* cited by examiner

WATERCRAFT SECUREMENT DEVICE

RELATED APPLICATION

This application claims priority to U.S. Provisional Application Ser. No. 62/323,419 filed Apr. 15, 2016 and to U.S. Provisional Application Ser. No. 62/443,911, filed Jan. 9, 2017, which are incorporated herein in their entirety.

TECHNICAL FIELD

This application generally relates to watercraft moorings and, more particularly, to devices for pulling and securing a watercraft to a mooring.

BACKGROUND OF THE INVENTION

A mooring refers to the securement of a boat or other watercraft to an anchoring structure such as a dock or pier. Different techniques exist for securing a watercraft using ropes, chains, and/or anchors, with the use of ropes being the most common for smaller vessels. The problem with ropes is that an individual is required to tie complex knots on both the docking location and the boat in order to properly secure the boat. Performing this task is time consuming and can prove difficult, as the individual may need to jump between the boat and dock in order to manually draw the boat to the dock and tie a knot. Due to the complexity and hazards, boat owners may become lazy with knot tying, putting themselves and others at risk for potential costs relating to property damage or even bodily harm.

Due to the problems inherent in rope moorings, it is desirable to have a device for securing a watercraft to a pier or dock that eliminates the need for tying knots. In particular, it is desirable to have a watercraft securement device that facilitates a quick, secure attachment of a boat to a dock, while also allowing for a quick and easy release of the device upon departure from the mooring. Furthermore, it is desirable to provide a watercraft securement device that is easy to use, safe, and effective.

SUMMARY OF THE INVENTION

A watercraft securement device is described herein which enables an individual to quickly secure a boat or other watercraft to a dock, pier or other anchoring structure. According to one embodiment, the device includes a boat attachment line having a distal end loop adapted for attachment to a watercraft, a free end, and an adjustable length between the distal end loop and free end. The device further includes a dock attachment line having a proximal end loop adapted for attachment to a pier, a distal end loop attached to a housing of the device, and a fixed length between the proximal and distal end loops. A tensioning apparatus is provided for adjusting the length of the boat attachment line. In one embodiment, the tensioning apparatus includes a pulley for engaging and tightening the boat attachment line. A ratchet mechanism is integral with the pulley for limiting the rotation of the pulley to one direction when the ratchet mechanism is engaged, and allowing free rotation of the pulley when the ratcheting mechanism is released. Pulling on a free end of the boat attachment line draws the adjustable length of the line through the tensioning apparatus allowing a boat to be quickly secured to a pier. A release lever is also provided for releasing the ratcheting mechanism to loosen the boat attachment line between the boat and pier.

BRIEF DESCRIPTION OF THE DRAWINGS

The present disclosure will be more readily understood from a detailed description of some example embodiments taken in conjunction with the following figures.

DETAILED DESCRIPTION

Various non-limiting embodiments of the present disclosure will now be described to provide an overall understanding of the principles of the structure, function, and use of the apparatus disclosed herein. One or more examples of these non-limiting embodiments are illustrated in the accompanying drawings. Those of ordinary skill in the art will understand that the apparatus described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Figure 1:
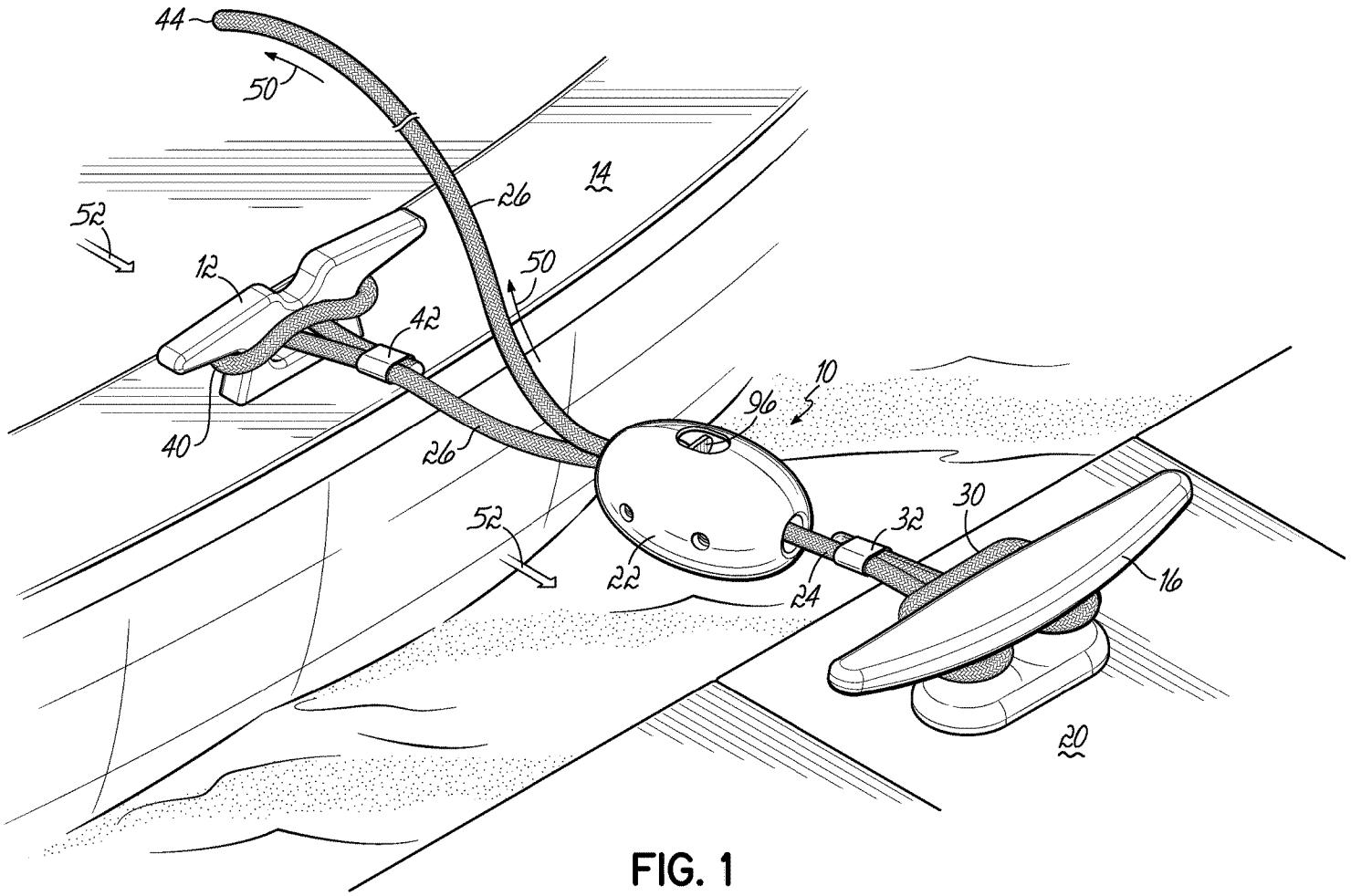
FIG. 1 is a diagrammatic view showing an exemplary embodiment of the watercraft securement device described herein being used to pull a boat towards a pier.

The presently disclosed embodiments are generally directed to a watercraft securement device. The device described herein includes a tensioning apparatus to enable a quick, secure connection of a boat or other watercraft to a pier, dock, or similar structure. The present device enables a boat attachment line to be pulled under tension through a ratcheting mechanism in order to shorten the length of line between the boat and pier to quickly pull the boat towards the pier. To loosen the boat attachment, the ratcheting mechanism is released, allowing the boat to move away from the pier. Turning now to the drawing figures, wherein like numbers indicate like features through the views, FIG. 1 illustrates an exemplary embodiment of a watercraft securement device 10 shown connecting a cleat 12 on a boat 14 with a cleat 16 on an anchoring structure such as, for example, a pier 20. Device 10 is described herein in connection with securing a boat to a pier. However, it is envisioned that device 10 can be used for securing any type of watercraft to an anchoring structure, and may also be utilized in other applications, situations, and scenarios where it is desirable to quickly pull and secure an object to an anchoring structure or to another object. These other applications include, but are not limited to, securing an aircraft or helicopter to a ground structure and hoisting an animal carcass.

Figure 2:
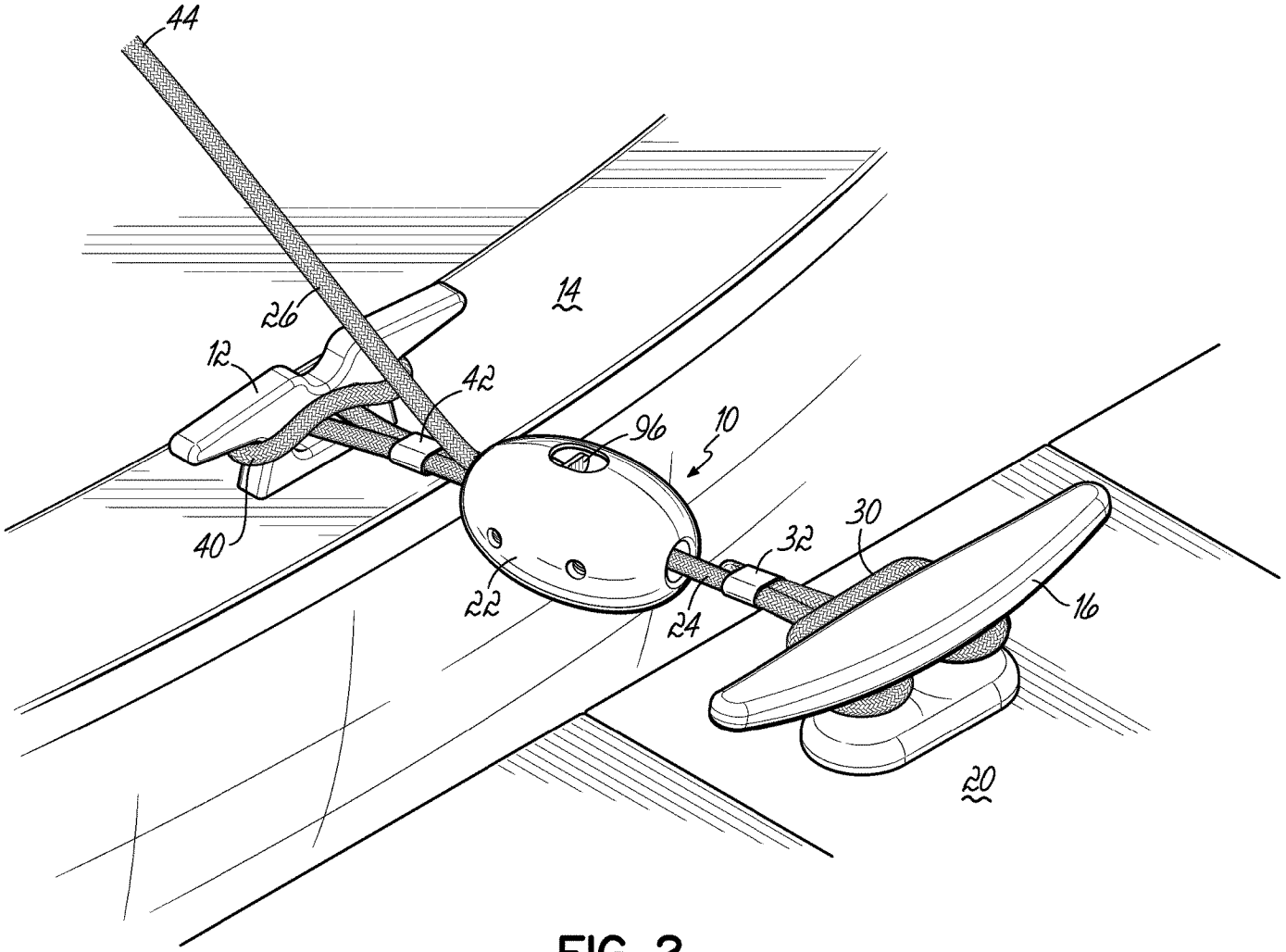
FIG. 2 is a diagrammatic view similar to FIG. 1, showing the securement device in a fully tightened position with the boat against the pier.

As shown in FIGS. 1 and 2, the watercraft securement device 10 includes a housing 22. The housing 22 may be comprised of any material and, in particular, may be comprised of a light-weight material, such as plastic, to enable the housing to float on the surface of water. Foam or other material may be included in the housing 22 to increase buoyancy. First and second attachment lines 24, 26 extend from opposite ends of the housing 22. The attachment lines 24, 26 comprise a length of flexible material which may be rope, cord or objects having similar properties. The first attachment line 24, referred to herein as the dock attachment line, includes a closed loop 30 formed in the proximal end of the line for attachment to the pier 20. Loop 30 is formed by turning the free end of the dock attachment line 24 back upon itself, and fastening the end, as indicated at 32, onto the line using any conventional fastening means known to those skilled in the art including, but not limited to, sewing, stitching, heat sealing, and metal clip binding. Loop 30 is sized for connecting attachment line 24 to a post, cleat or other similar object on a pier. A second loop is also formed in the opposite, distal end of the dock attachment line 24. This distal loop, which will be described in more detail below, connects the dock attachment line 24 to the housing 22.

The second attachment line 26, referred to herein as the boat attachment line, extends from housing 22 in the opposite direction of dock attachment line 24. A closed loop 40 is formed in a distal end of the boat attachment line 26 by folding a length of the line back onto itself and fastening the end of the folded piece using any conventional fastening means including a band 42. The opposite end of boat attachment line 26 is maintained as a free end 44, with an adjustable length between the free end and loop 40. The adjustable length of boat attachment line 26 is fed through a tensioning apparatus in housing 22. When device 10 is attached to both boat 14 and pier 20, free end 44 of the boat attachment line 26 can be pulled in a direction away from housing 22, as indicated by arrows 50, to shorten the corresponding length of the line between the boat and housing. As the length of boat attachment line 26 between the boat 14 and housing 22 is reduced, the boat is pulled towards the pier 20, as indicated by arrow 52 in FIG. 2, until the boat reaches the pier.

Figure 3:
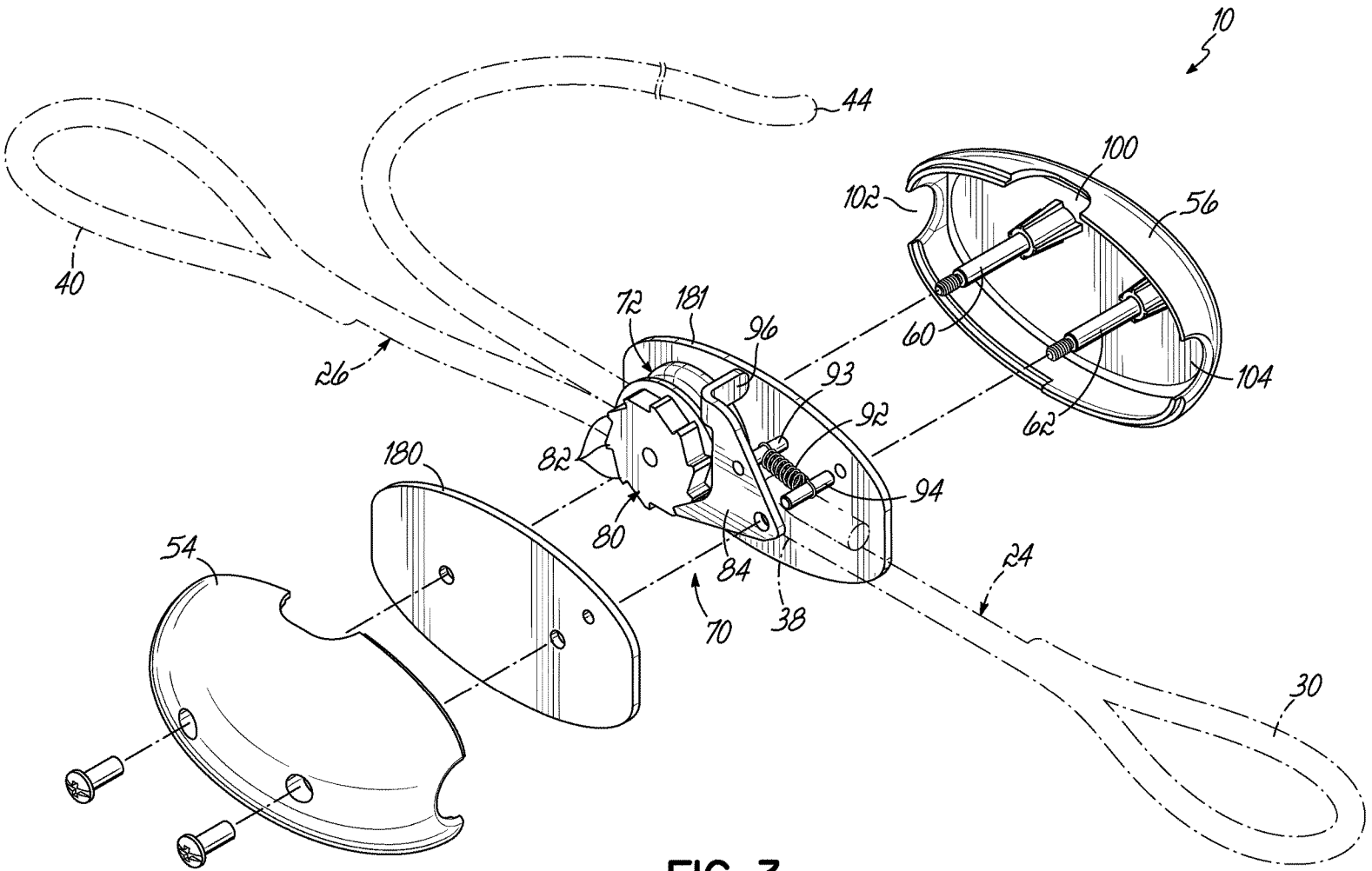
FIG. 3 is an exploded view of the securement device.
Figure 4:
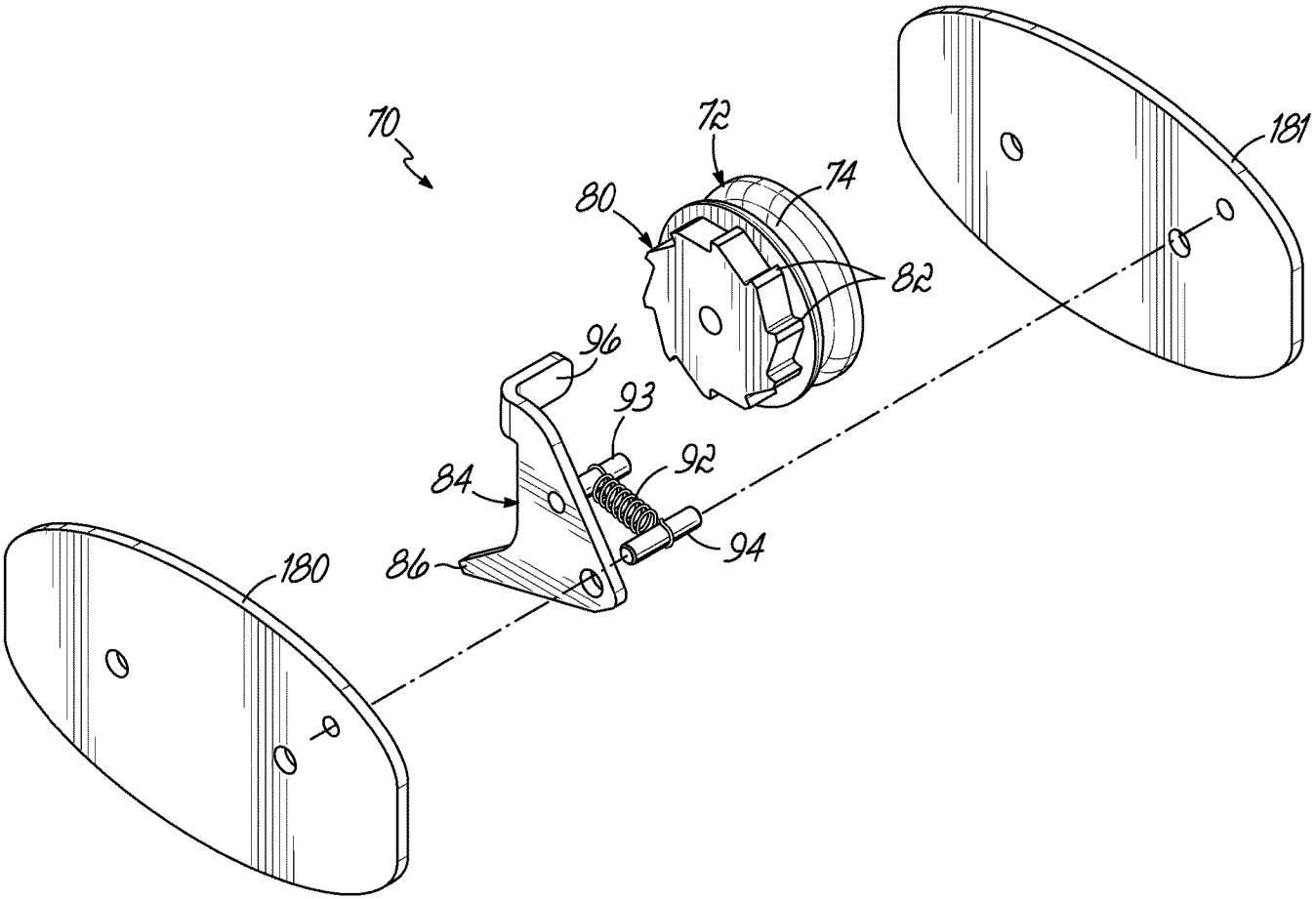
FIG. 4 is a more detailed, exploded view of the tensioning apparatus shown in FIG. 3.
Figure 9:
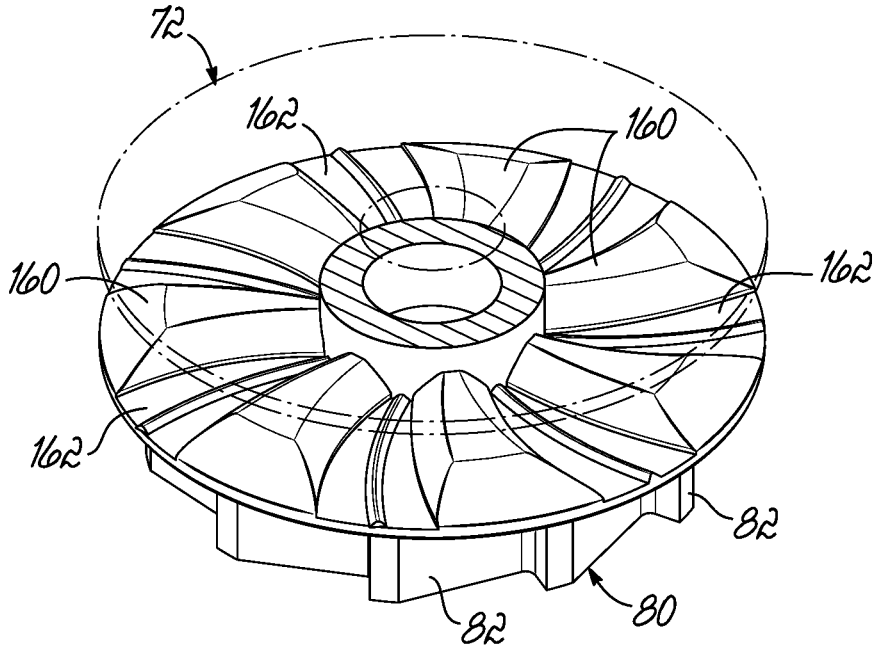
FIG. 9 is a partial perspective view of an alternative embodiment for the pulley.

As shown in FIG. 3, housing 22 may be formed from divisible halves 54, 56 attached together using conventional threaded fasteners 60, 62. Housing 22 forms a chamber in which a tensioning apparatus 70 is located for adjusting the length of the boat attachment line 26 held in tension between the housing and boat 14. Tensioning apparatus 70 includes a pulley 72 mounted for rotation between support partitions 180, 181 within housing 22. A cylindrical section of housing fastener 60 forms a rotational axis extending through the center of pulley 72. As shown in greater detail in FIG. 4, pulley 72 includes a channel 74 for grasping boat attachment line 26. The facing surfaces of channel 74 are slightly rounded and converge towards the center of the pulley 72 to create a wedging effect for gripping the boat attachment line 26 as the line extends around the pulley. In an alternative embodiment, a plurality of alternating ridges 160 and grooves 162, such as shown in FIG. 9, are provided in the facing surfaces of the pulley 72 to increase the grip of the pulley on boat attachment line 26. For clarity, FIG. 9 shows only one of the facing surfaces of the pulley, with the other half of the pulley shown in phantom. The other pulley surface would be a mirror image of the one shown in order to provide contact with the ridges 160 and grooves 162 on two surfaces of the boat attachment line 26 as the line is drawn through the pulley. Ridges 160 have a flat or rounded upper surface, as shown in FIG. 9, to increase the effective grip on the attachment line 26 without fraying or otherwise damaging the line. The gripping effect of the ridges 160 and grooves 162 pulls the boat attachment line 26 forward with the turning of the pulley 72.

Figure 5A:
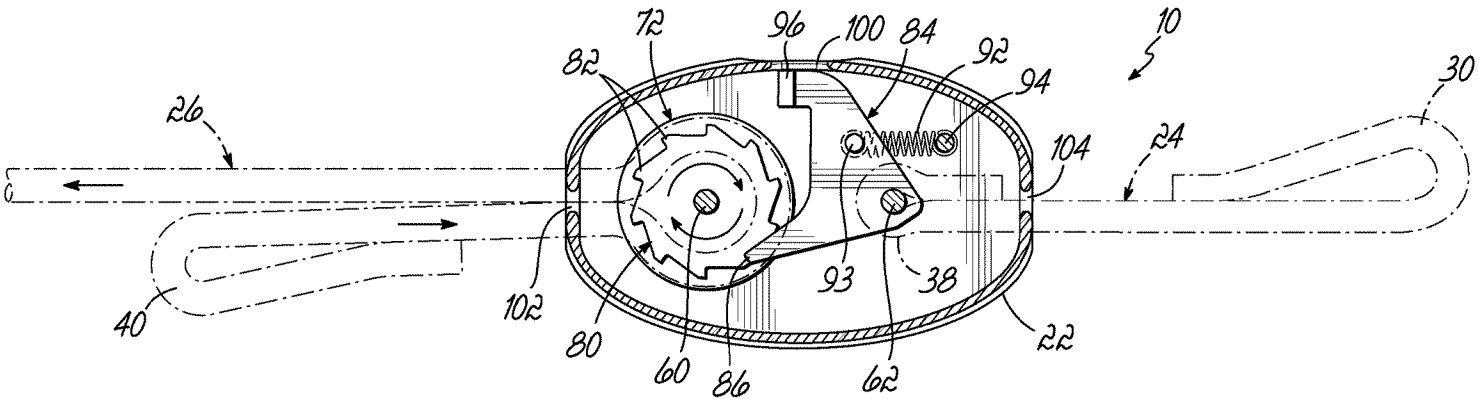
FIG. 5A is a side, sectional view of the housing and tensioning apparatus depicting the ratcheting mechanism engaged to limit rotation of the pulley to a clockwise pulling direction.
Figure 5B:
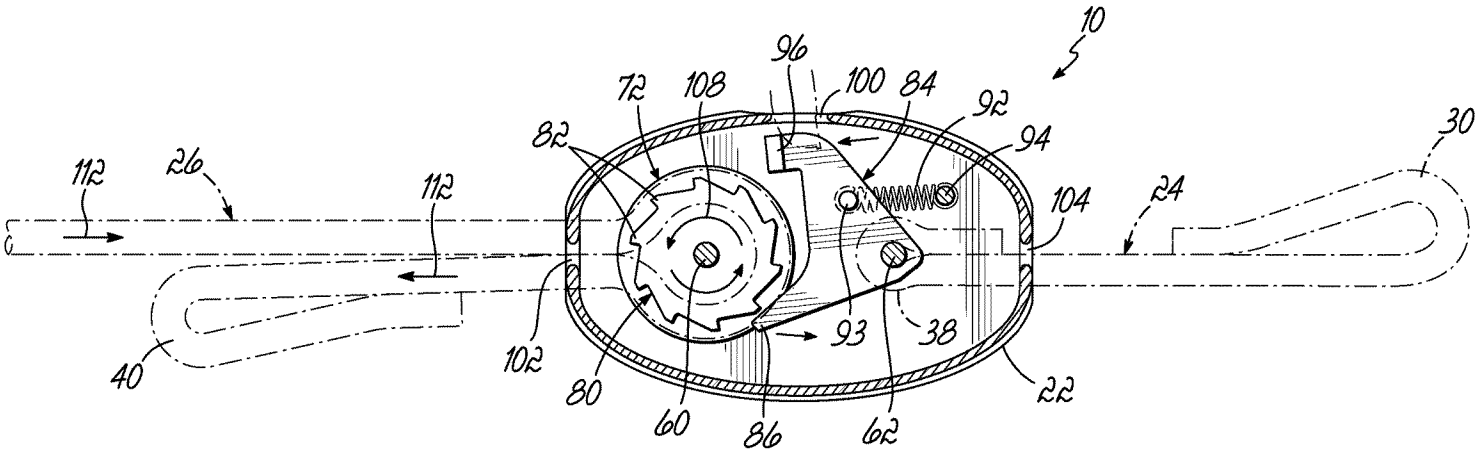
FIG. 5B is a side, sectional view of the housing and tensioning apparatus depicting the ratcheting mechanism released to allow bidirectional movement of the boat attachment line.

Returning to FIG. 4, a ratchet mechanism 80 is integrally formed to and concentric with pulley 72. A series of ratchet teeth, indicated at 82, project radially about the circumference of the ratchet mechanism 80 to provide the capability for one-way ratchet advancement of the boat attachment line 26. A latch 84 is provided adjacent ratchet mechanism 80 and includes a pawl 86 for engagement with ratchet teeth 82. Teeth 82 are shaped to allow the pawl 86 to pass over the teeth in a first direction, and prevent movement of the pawl in the opposite direction, thereby limiting rotation of the pulley to a single direction when the latch 84 engages the ratchet mechanism 80. Latch 84 is pivotally mounted on a cylindrical section of housing fastener 62. The housing fastener 62 also serves as the connection inside housing 22 for the distal end loop 38 of the dock attachment line 24 as shown in FIGS. 5A and 5B. A free standing post 93 is mounted on latch 84. A spring 92 is connected between post 93 and a pin 94 mounted between support partitions 180, 181. Spring 92 biases pawl 86 into the spaces between the ratchet teeth 82, as shown in FIG. 5A. Latch 84 further includes a release lever 96 accessible through an opening 100 in housing 22. Actuating the release lever 96, as shown in FIG. 5B, pivots latch 84 about fastener 62 against the force of spring 92 to move pawl 86 out of contact with ratchet teeth 82.

Openings 102, 104 are provided in opposite ends of housing 22, one for the boat attachment line 26 and the other for the dock attachment line 24. The openings 102, 104 are of a restricted size to maintain the attachment lines in proper alignment. The opening 102 for the boat attachment line 26 is shaped to allow free movement of the doubled over attachment line in and out of the housing 22, while preventing the line from tangling or disengaging from channel 74 of the pulley 72. Housing opening 102 also guides the boat attachment line 26 around pulley 72 to ensure maximum contact between the line and the pulley. Dock attachment line 24 is a fixed length extending through housing opening 104 between fastener 62 and the proximal end loop 30.

As shown in FIG. 5A, when pawl 86 engages ratchet teeth 82, pulling on the free end 44 of boat attachment line 26 will rotate pulley 72 in a clockwise direction, shortening and tensioning the length of the attachment line between the boat and the housing 22. When the dock attachment line 24 is connected to a pier, pulling the free end 44 of boat attachment line 26 through pulley 72 will tension the line and pull the boat towards the pier. Actuating the release tab 96, as shown in FIG. 5B, allows the pulley 72 to rotate in the opposite direction, as indicated by arrows 108, releasing the tension in the boat attachment line. As the tension is released, and the boat attachment line 26 loosened, the looped end 40 of the boat attachment line can be pulled as desired, as indicated by arrow 112, to increase the length of the line between the boat and pier. A knot or stopper (not shown), having a width wider than housing opening 102, may be attached to the free end 44 of the boat attachment line 26 to prevent the free end of the line from being pulled through the housing 22. Alternatively, the free end 44 of the boat attachment line 26 may be sealed to prevent tearing and fraying, and to allow the free end to be easily fed through housing opening 102 and pulley 72, if the line were to be pulled from the housing 22.

In using the device 10, dock attachment line 24 may be connected first to a pier, and then the boat attachment line 26 may be connected to a boat, or vice-versa. Once the device 10 is connected to both a boat and pier, the boat can be pulled towards the pier by pulling the free end 44 of the boat attachment line 26 through the tensioning apparatus 70. To release the tension in boat attachment line 26, release lever 96 is drawn back to disengage pawl 86 in tensioning apparatus 70. Releasing the line tension allows the looped end 40 of the boat attachment line to be pulled back distally, increasing the distance between the boat and pier.

Figure 6:
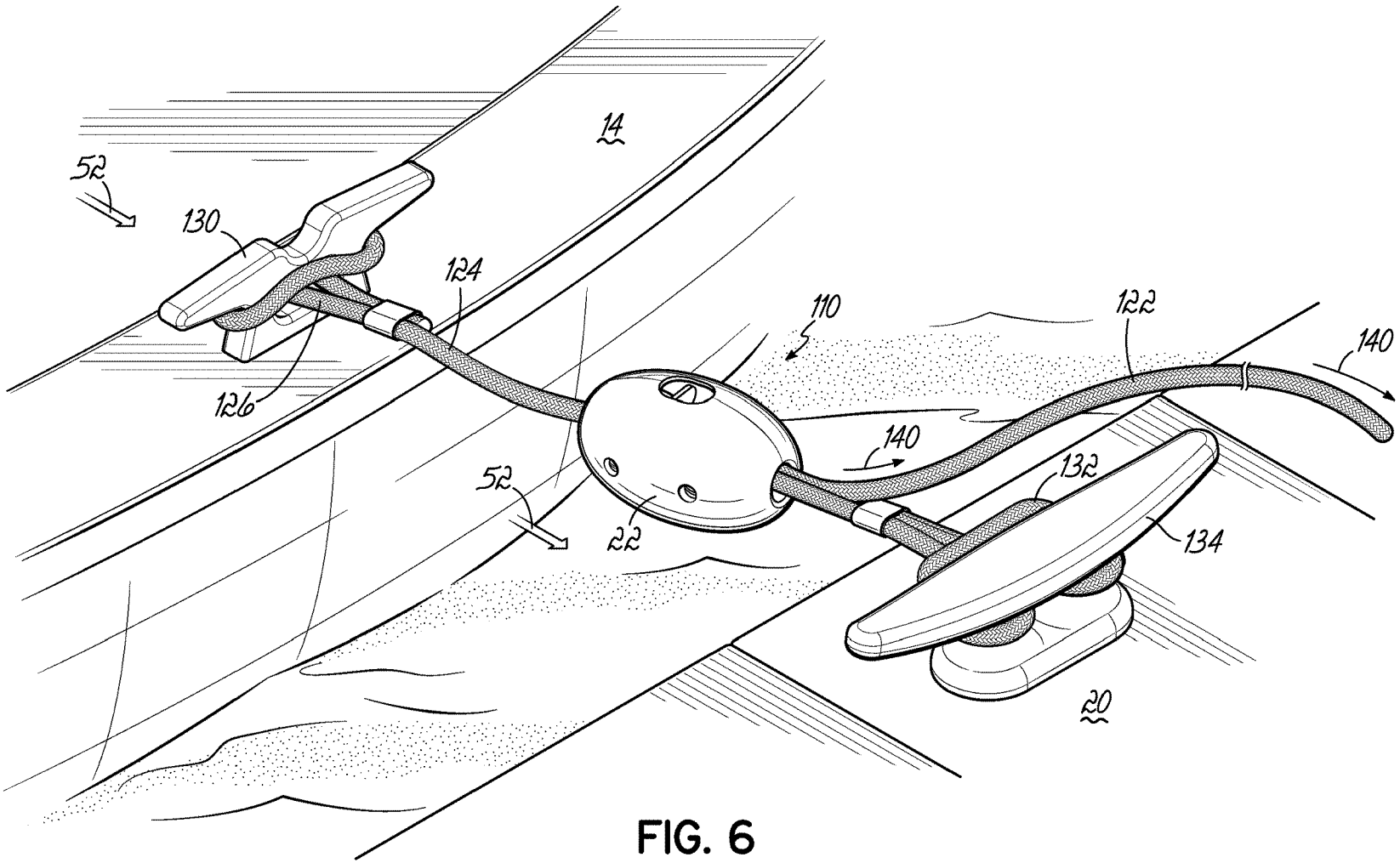
FIG. 6 is a diagrammatic view showing an alternative embodiment of the watercraft securement device.

FIG. 6 shows an alternative embodiment of a watercraft securement device 110 having an adjustable length dock attachment line 122. In this embodiment, the boat attachment line 124 includes an end loop 126 for attaching the line to a cleat 130 or other fixed structure on the watercraft. The dock attachment line 122 includes an end loop 132 for attachment to a cleat 134 on the pier. Once the device 120 is connected to both a boat and pier, the boat can be quickly pulled towards the pier by pulling on a free end of the dock attachment line 122, as indicated by arrow 140, to draw the adjustable length of the dock attachment line through the tensioning apparatus. To release the tension in the dock attachment line 122, the release lever in the tensioning apparatus is drawn back to disengage the pawl, as in the prior embodiment. Releasing the line tension allows the dock attachment line 122 to be pulled back distally through the pulley 72 to increase the distance between the boat and pier.

Figure 7:
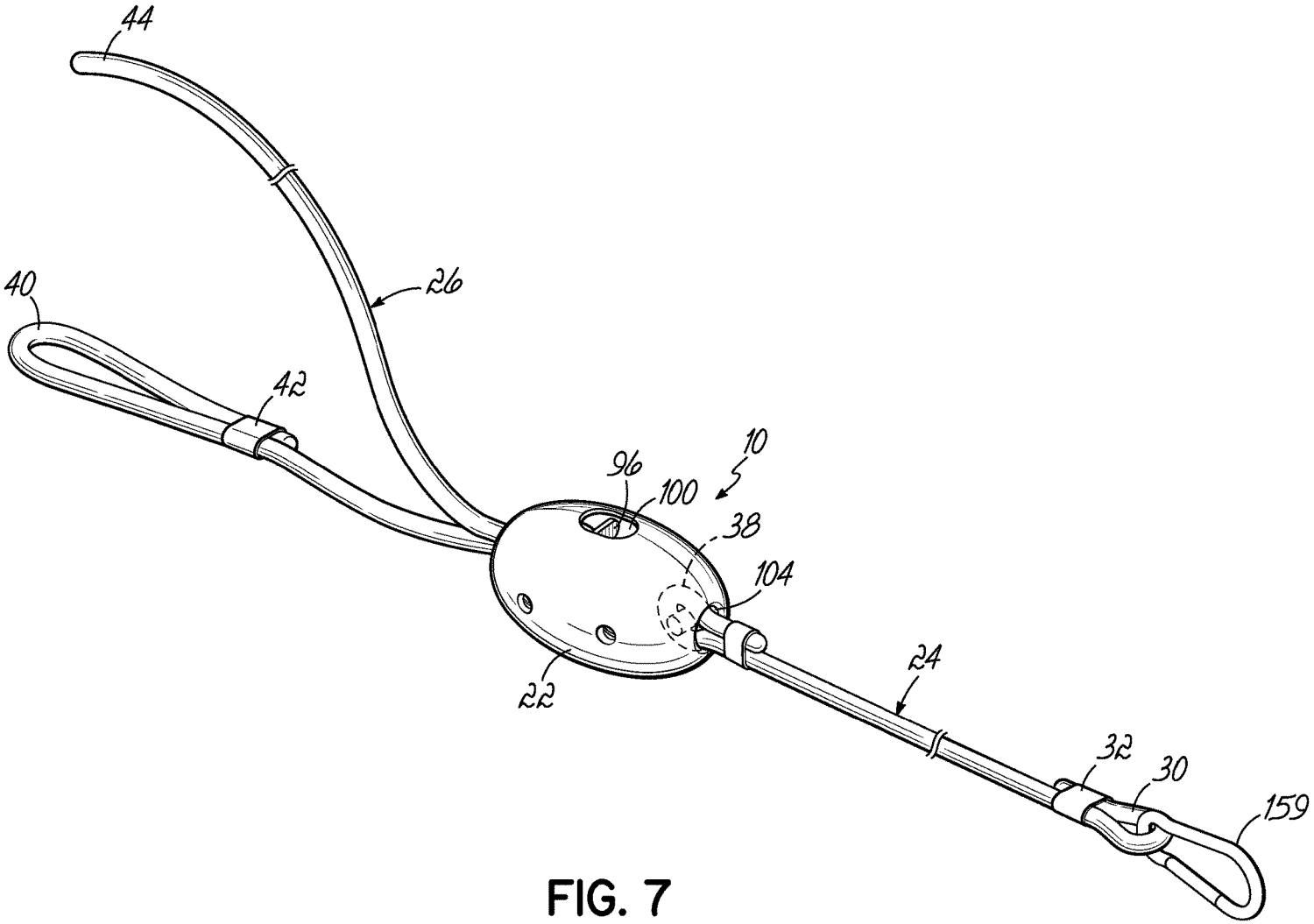
FIG. 7 is a perspective view of another alternative embodiment for the securement device.

FIG. 7 depicts another embodiment for a securement device in which a carabiner clip 159 is located at the proximal end of the fixed length attachment line, which may be either a boat attachment line or a dock attachment line. Clip 159 allows the device 10 to be clipped to a structure rather than being attached via a loop as in the first embodiment described above. Additionally, clip 159 provides the option of clipping the proximal end of the attachment line back onto the length of the line in order to form an adjustable temporary loop at the proximal end of the line.

Figure 8:
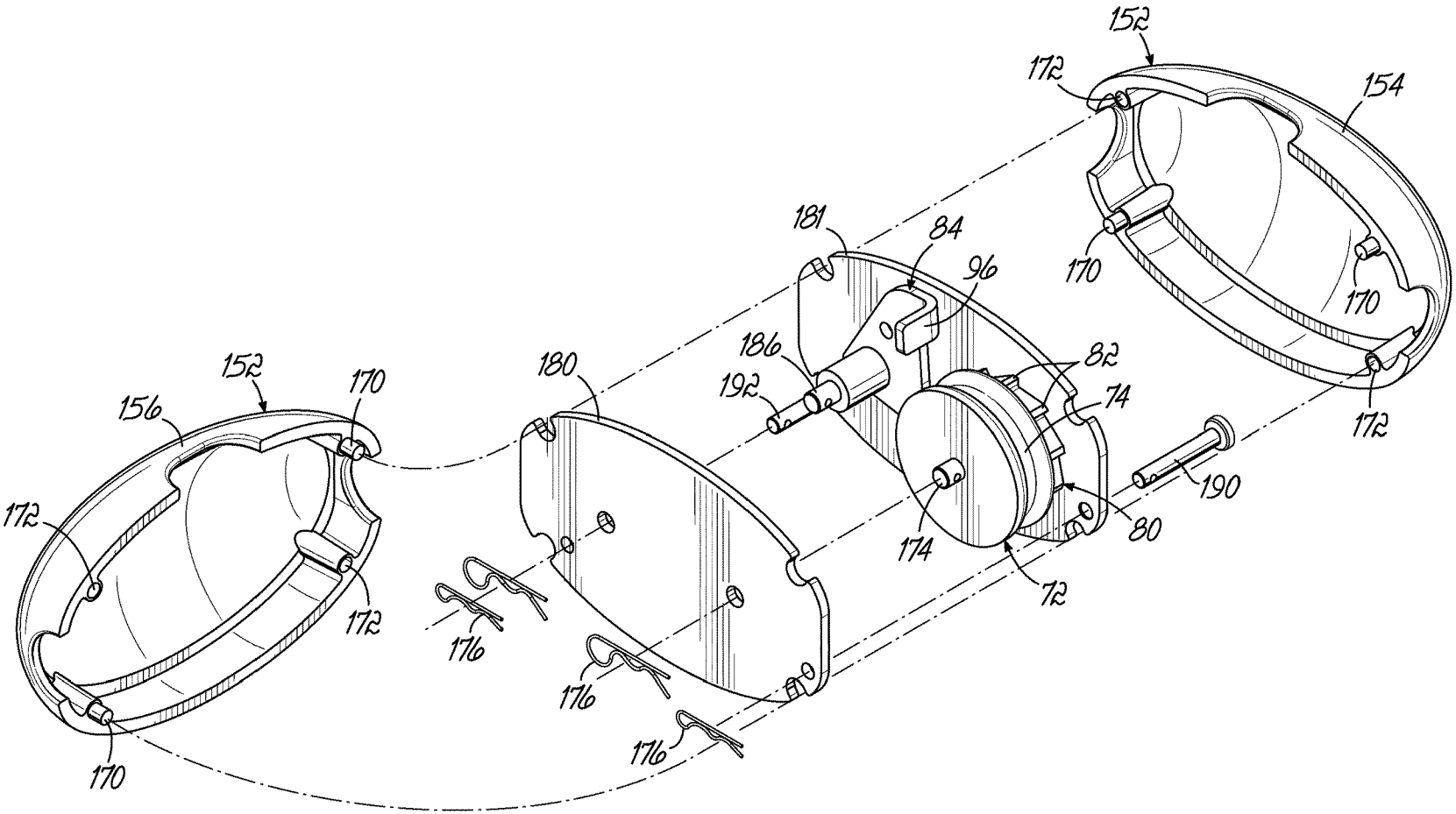
FIG. 8 is an exploded view showing an alternative embodiment for the housing of the securement device.

FIG. 8 depicts an alternative embodiment for the device housing. In this embodiment, the housing 152 is formed from divisible halves 154, 156 which are snap fit together using a plurality of boss couplings 170, 172. Boss couplings 170, 172 are spaced about the inner perimeter of the housing 152 as shown, eliminating the need for mounting fasteners through the wall of the housing. In this embodiment, pulley 72 pivots on a post 174. A cotter pin 176 secures post 174 on the opposite side of support partition 180, which is fixed inside the housing. Additional cotter pins secure a pivot post 186 for latch 84 as well as connector pins 190, 192 for holding support partitions 180, 181 together.

While various embodiments have been described herein, it should be apparent that various modifications, alterations, and adaptations to those embodiments may occur to persons skilled in the art with attainment of at least some of the advantages. The disclosed embodiments are therefore intended to include all such modifications, alterations, and adaptations without departing from the scope of the embodiments as set forth herein.

What is claimed is:

1. A watercraft securement device, comprising:

a boat attachment line configured for connection to a watercraft;

a dock attachment line configured for connection to an anchoring structure; and a tensioning apparatus connected to the boat attachment line and the dock attachment line, the tensioning apparatus being configured to adjust a length of one of the boat attachment line or the dock attachment line, the tensioning apparatus including first and second support partitions, a pulley located between the first and second support partitions for engaging an adjustable length of the one of the boat attachment line or the dock attachment line and a ratcheting mechanism, the ratcheting mechanism operating to permit rotation of the pulley in only one direction when engaged, and to permit free rotation of the pulley when released, the ratcheting mechanism maintaining tension as the adjustable length is pulled through the pulley, wherein the tensioning apparatus is located within a chamber defined by a housing, with the housing at least partially enclosing the tensioning apparatus.

2. The device of claim 1, wherein the housing comprises a float.

3. The device of claim 1, wherein the boat attachment line has an adjustable length.

4. The device of claim 3, wherein the dock attachment line further comprises a proximal end loop, a distal end loop, and a fixed length between the proximal and distal end loops.

5. The device of claim 1, wherein the dock attachment line has an adjustable length.

6. The device of claim 5, wherein the boat attachment line further comprises a proximal end loop, a distal end loop, and a fixed length between the proximal and distal end loops.

7. The device of claim 1, wherein the ratcheting mechanism includes a plurality of teeth circumferentially spaced about a surface of the pulley, and a pivotable latch, the pivotable latch engaging one or more of the teeth in a first position to limit rotation of the pulley to one direction, the pivotable latch being pivotable to a second position away from the teeth, to allow rotation of the pulley in two directions.

8. The device of claim 1, wherein the boat attachment line includes a looped end for attachment to the watercraft.

9. The device of claim 1, wherein the dock attachment line includes a looped end for attachment to the anchoring structure.

10. A method for pulling and securing a watercraft to an anchoring structure using a tensioning apparatus including first and second support partitions, a pulley located between the first and second support partitions, and a ratcheting mechanism, and a housing defining a chamber in which the tensioning apparatus is located, with the housing at least partially enclosing the tensioning apparatus, the method comprising the steps of:

attaching a first end of a boat attachment line to the watercraft;

attaching a first end of a dock attachment line to the anchoring structure;

providing a tensioning apparatus between the boat attachment line and the dock attachment line, the tensioning apparatus engaging an adjustable length of one of the boat attachment line or the dock attachment line; and pulling on a free end of the adjustable length to draw the adjustable length through the tensioning apparatus and shorten a distance between the watercraft and anchoring structure.

11. The method of claim 10, further comprising the step of providing a releasable latching member in the tensioning apparatus, the latching member allowing the adjustable length to move in only a single direction when the latching member is engaged to tension the attachment lines.

12. The method of claim 11, further comprising the step of releasing the latching member to release the tension in the attachment lines.

13. The method of claim 12, wherein the step of releasing the latching member further comprises manually manipulating a lever to disengage the latching member from a ratcheting mechanism in the tensioning apparatus.

14. The method of claim 12, wherein the step of releasing the latching member further comprises allowing the adjustable length to move within the tensioning apparatus in an opposite direction to increase the distance between the watercraft and anchoring structure.

15. The method of claim 10, wherein the tensioning apparatus engages an adjustable length of the boat attachment line.

16. The method of claim 10, wherein the housing comprises a float.

* * * * *